US006822644B1

(12) United States Patent
Awamoto et al.

(10) Patent No.: US 6,822,644 B1
(45) Date of Patent: Nov. 23, 2004

(54) METHOD AND CIRCUIT FOR DRIVING CAPACITIVE LOAD

(75) Inventors: Kenji Awamoto, Kawasaki (JP); Yasunobu Hashimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/559,633

(22) Filed: Apr. 28, 2000

(30) Foreign Application Priority Data

Jun. 30, 1999 (JP) ..... 11-184610

(51) Int. Cl.[7] ..... G09G 5/00
(52) U.S. Cl. ..... 345/211; 345/208
(58) Field of Search ..... 345/55–63, 211, 345/77, 204, 208, 88, 94, 96; 315/167, 169; 313/89

(56) References Cited

U.S. PATENT DOCUMENTS 3,579,015 A * 5/1971 Gregory ..... 313/89
4,027,195 A * 5/1977 Shutoh et al. ..... 315/169 TV
4,692,665 A * 9/1987 Sakuma ..... 315/169.4
5,541,542 A * 7/1996 Shibuya et al. ..... 327/172
5,663,741 A * 9/1997 Kanazawa ..... 345/66
5,745,085 A * 4/1998 Tomio et al. ..... 345/63
5,745,086 A 4/1998 Weber ..... 345/63
5,748,169 A * 5/1998 Okumura et al. ..... 345/100
5,909,199 A * 6/1999 Miyazaki et al. ..... 345/60
6,011,355 A * 1/2000 Nagai ..... 315/167.3
6,104,362 A * 8/2000 Kuriyama et al. ..... 345/63
6,195,075 B1 * 2/2001 Shino et al. ..... 345/68
6,249,087 B1 * 6/2001 Takayama et al. ..... 315/169.1
6,337,673 B1 * 1/2002 Ide et al. ..... 345/60
2002/0122016 A1 * 9/2002 Iwasa et al. ..... 345/60

FOREIGN PATENT DOCUMENTS

JP 51-147947 12/1976
JP 06-130912 * 5/1994 ..... 345/68
JP 11-069193 * 3/1999
JP 11-073155 3/1999

* cited by examiner

*Primary Examiner*—Amare Mengistu
*Assistant Examiner*—Prabodh M. Dharia
(74) *Attorney, Agent, or Firm*—Staas & Halsey LLP

(57) ABSTRACT

In a method of setting of a step height, in application of a step voltage to a pair of electrodes of a capacitive load, a current path is provided from a power source to one of the electrodes via a current restricting resistor and a switching path of a semiconductor switching device. The semiconductor switching device is controlled to opened or closed states so as to transfer charge from the power source to the electrode intermittently, whereby the charge quantity accumulated in a capacitor between the electrodes is increased, step by step.

10 Claims, 10 Drawing Sheets

METHOD AND CIRCUIT FOR DRIVING CAPACITIVE LOAD

BACKGROUND OF THE INVENTION

1. Field of the Invention

The present invention relates to a method and a circuit for driving a capacitive load, of the type in a display of a plasma display panel. Each of the cells that constitute the screen of the plasma display panel is a capacitive load for a power source circuit except at the time of gas discharge. A drive circuit that can supply a complicated voltage waveform is desirable, so as to realize a stable display with high quality.

2. Description of the Prior Art

An AC type plasma display panel utilizes a memory function of a dielectric layer that covers the electrodes. Namely, addressing is performed by a line scanning format for controlling charge quantity of the cell in accordance with display data, and then a sustaining voltage Vs having alternate polarity is applied to a pair of the electrodes. The sustaining voltage Vs satisfies the relationship (1) below.

$$Vf-Vw<Vs<Vf \quad (1)$$

Here, Vf is a discharge starting voltage and Vw is a wall voltage between the electrodes.

The application of the sustaining voltage Vs makes a cell voltage Vc (a sum of the applied voltage and the wall voltage, which is also referred to as an effective voltage) exceed the discharge starting voltage Vf only in the cell in which the wall charge exists, and causes the discharge. When the period of application of the sustaining voltage Vs is shortened, an apparently continuous ON state is obtained. Since the cell of the plasma display panel is a binary light emitting element, a gradation tone is reproduced by setting the discharge times of a field for each cell in accordance with the gradation level. A color display is a kind of the gradation display and is obtained by a combination of intensities of three primary colors. In a method of displaying the gradation, a field is made of plural subfields having a weight of the intensity, and the number of total discharge times is set by a combination of on or off for each subfield. In general, an addressing preparation period (that is also referred to as an initialization period) is assigned to each subfield adding to an addressing period and a sustaining period (that is also referred to a display period). At the time of finishing the sustaining period, there are cells with remaining wall charge and cells 10 without the wall charge. Therefore, the charged state of all cells is uniformed in the addressing preparation period so as to improve the reliability of the addressing.

As an addressing preparation process, there is a method of applying a ramp voltage having a small gradient to cells (as being disclosed in U.S. Pat. No. 5,745,086). When the applied voltage increases gradually and reaches the discharge starting voltage, a first discharge occurs. Since the wall voltage is decreased a little by the discharge and the cell voltage drops, the discharge finishes shortly. However, another discharge will occur since the increase of the applied voltage continues. Thus, the discharge repeats in a short period. As the speed of increase of the applied voltage becomes slow, the repeated discharges become a continuous discharge without an interval. The discharge is a weak discharge (a micro discharge) in which the polarity of the wall voltage does not alter, so the light emitting quantity is substantially zero. The preparation process does not affect a contrast. The cell voltage is maintained substantially at the discharge starting voltage Vf by the micro discharge.

However, the wall voltage is decreased gradually by every micro discharge. The wall voltage value Vwr at the time when the application of the ramp voltage is finished depends on the discharge starting voltage Vf (Vwr=Vf−Vr). Thus, by generating the micro discharge periodically, the wall charge is adjusted for each cell so as to compensate a dispersion of the discharge starting voltage Vf that can be among cells. Accordingly, the intensity of discharge in the following addressing is uniformed, so that the incidence of address error can be decreased.

A step voltage that increases step by step is more preferable than the ramp voltage that increases continuously for adjusting the charge as the addressing preparation. It is because that the ramp voltage causes the increase of the discharge intensity along with the repeated micro discharge. It is considered that a cause of this phenomenon is a priming effect caused by accumulation of the space charge. Since a variation width of the cell voltage is increased by the increase of the discharge intensity, the wall voltage at the time of finishing the application of voltage can have an error. There is also a problem that an undesired light emission can occur. In contrast to this, the step voltage can make the intensity of the micro discharge uniform by selecting the waveform.

Since the discharge starting voltage Vf of a plasma display panel is approximately 170–200 volts, a step voltage whose maximum voltage is approximately 250–300 volts should be applied. Conventionally, plural bias voltage sources having different output voltages are prepared and one of them is selected to be connected to the electrode by using a switching device, so that the application of a step voltage is performed.

The conventional circuit has a disadvantage in that plural power sources and switching devices are necessary for the number of steps of the step voltage, and so the circuit becomes large when increasing the number of steps. In addition, though the waveform can be changed by setting the control timing of the switching device, the voltage difference between steps and the voltage transition characteristics between steps are fixed.

SUMMARY OF THE INVENTION

The object of the present invention is to realize a simple circuit for setting a desired step height in the application of the step voltage. Another object is to set the voltage transition characteristics between steps so as to obtain various waveforms. Still another object is to increase a flexibility of setting a waveform in driving a gas discharge display device.

The present invention utilizes a charge accumulation function of a capacitive load and sets a waveform by controlling on and off of charging current.

According to a first aspect, the present invention provides a method of applying a step voltage to a pair of electrodes for driving a capacitive load. The method includes the steps of providing a current path from a power source to one of the electrodes via a current restricting resistor and a switching path of a semiconductor switching device in order, and transferring charge from the power source to the electrode intermittently by switching control of the semiconductor switching device, so as to increase charge quantity accumulated in a capacitor between the electrodes step by step.

According to a second aspect of the present invention, the voltage between the switching control terminal of the semiconductor switching device and the power source is maintained at a constant value in a period of closing the switching path, so as to make the step to step portion of the waveform of the charge voltage ramp-like shape.

According to a third aspect, the present invention provides a method of adjusting charge by gradually decreasing wall charge of a dielectric that covers the pair of electrodes as a preparation process of addressing to control charge distribution of a screen for driving a gas discharge display device. The method includes the steps of providing a current path from a power source to one of the electrodes via a current restricting resistor and a switching path of a semiconductor switching device in order, and transferring charge from the power source to the electrode intermittently by switching control of the semiconductor switching device, so as to increase charge quantity accumulated in a capacitor between the electrodes step by step.

According to a fourth aspect, the present invention provides a drive circuit for adjusting charge by gradually decreasing wall charge of a dielectric that covers the pair of electrodes as a preparation process of addressing to control charge distribution of a screen in a gas discharge display device. The drive circuit includes a first semiconductor switching device for opening and closing the current path between an output terminal connected to one of the electrodes and a bias potential line, a current restricting resistor inserted between the bias potential line and the semiconductor switching device, a second semiconductor switching device for opening and closing the current path between the output terminal and the ground potential line, and a controller for controlling the first and the second semiconductor switching devices.

According to a fifth aspect, the drive circuit further includes a diode connected to the current restricting resistor in parallel and in the opposite direction, and a capacitor inserted between the terminal of the bias potential line side of the first semiconductor switching device and the ground potential line.

According to a sixth aspect, the drive circuit further includes a variable voltage source for switching the potential of the switching control terminal of the semiconductor switching device.

According to a seventh aspect, the controller includes a memory for memorizing pulse width modulation data used for the switching control.

According to an eighth aspect, the present invention provides a display device includes a drive circuit mentioned above as the fourth aspect and an AC type plasma display panel driven by the drive circuit.

DESCRIPTION OF THE PREFERRED EMBODIMENTS

Figure 1:
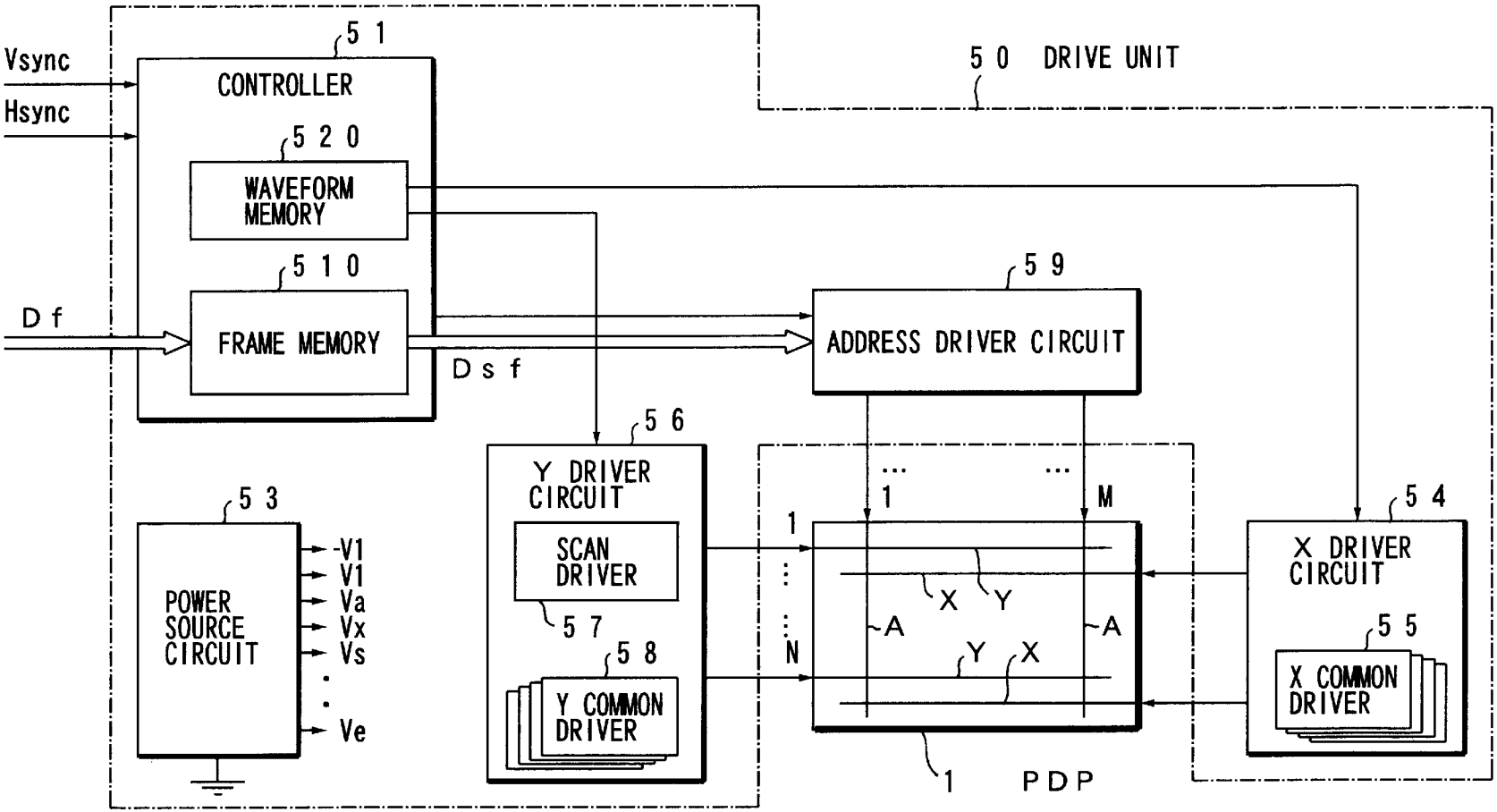
FIG. 1 is a block diagram of a display device according to the present invention.

FIG. 1 is a block diagram of a display device according to the present invention.

The display device 100 includes an AC type plasma display panel 1 that is a slim color display device and a drive unit 50 for selectively lighting cells that are arranged in M columns and N rows of a screen. The display device 100 is used for a wall-hung TV set or a monitor of a computer system.

The plasma display panel 1 has a three-electrode surface discharge structure in which pairs of first and second main electrodes X, Y are arranged in parallel for generating a sustain discharge (that is also referred to as a displaying discharge), and the main electrodes X, Y cross the address electrode A in each cell. The main electrodes X, Y extend in the row direction (the horizontal direction) of the screen, and the main electrode Y is used as a scanning electrode for selecting cells of a row in addressing. The address electrode A extends in the column direction (the vertical direction), and is used as a data electrode for selecting cells of a column. The area of the substrate surface in which the main electrodes and the address electrodes cross each other is a display area (i.e., a screen).

The drive unit 50 includes a controller 51, power source circuit 53, X driver circuit 54, Y driver circuit 56, and address driver circuit 59. The drive unit 50 is supplied with field data Df of each pixel representing the intensity level (the gradation level) of red, green and blue colors along with various synchronizing signals by external equipment such as a TV tuner or a computer.

The field data Df are converted into subfield data Dsf for the gradation display after being stored in a frame memory 510 of the controller 51. The subfield data Dsf is stored in the frame memory 510 and is transferred in series to the address driver circuit 59 along with the display. Each bit value of the subfield data Dsf is information indicating on and off of the cell in the subfield and, more strictly, information indicating whether or not an address discharge is necessary.

The X driver circuit 54 includes plural X common drivers 55, each of which corresponds to each block that is a dividend of the screen in the column direction. Each X common driver 55 controls the potential of the main electrodes X in a block. The Y driver circuit 56 includes a scan driver 57 and plural Y common drivers 58. The scan driver 57 is potential control means for row selection in the addressing. The Y common driver 58 controls the potential of the main electrodes Y in a block. The address driver circuit 59 controls potential of total M of address electrodes (data electrodes) A in accordance with the subfield data Dsf. These driver circuits are supplied with a power by the power source circuit 53 via wiring conductors (not shown).

Figure 2:
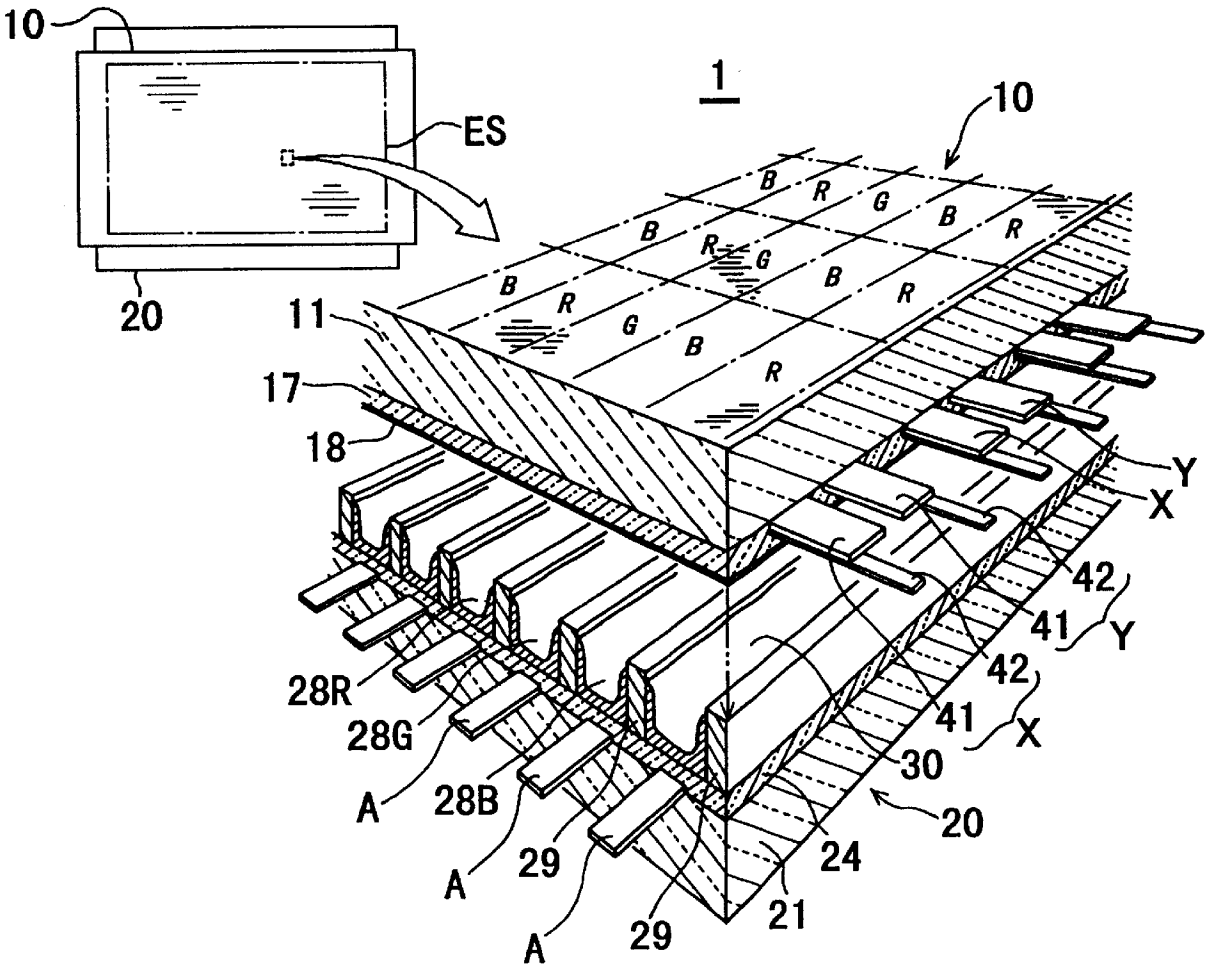
FIG. 2 is a perspective view showing the inner structure of a plasma display panel according to the present invention.

FIG. 2 is a perspective view showing the inner structure of a plasma display panel according to the present invention.

The plasma display panel 1 has a pair of main electrodes X, Y for each row, arranged on the inner surface of a glass substrate 11 of the front substrata structure 10. A row is a group of cells in the horizontal direction of the screen. Each of the main electrodes X, Y includes a transparent conductive film 41 and a metal film (a bus conductor) 42, which are covered with dielectric layer 17 having a thickness of approximately 30 microns of low melting point glass. The surface of the dielectric layer 17 is covered with a protection film 18 having a thickness of several thousands angstrom made of magnesia (MgO). The address electrodes A are arranged on the inner surface of the glass substrate 21 of the backside substrata structure 20 and are covered with a dielectric layer 24 having a thickness of approximately 10 microns. On the dielectric layer 24, a partition 29 having a height of 150 microns and linear ribbon shape in a plan view is disposed at each portion between the address electrodes A. These partitions 29 define subpixels (unit areas of light emission) of the discharge space 30 in the row direction and define the gap size of the discharge space 30. Three colors (red, green and blue) of fluorescent layers 28R, 28G and 28B for color display cover the inner surface of the backside including the upper portion of the address electrode A and the side face of the partition 29. The discharge space 30 is filled with a discharge gas containing neon as a main component and xenon, and the fluorescent layers 28R, 28G and 28B are pumped locally to emit light by ultraviolet rays emitted by the xenon upon discharge. A pixel of the display includes three subpixels arranged in the row direction. A structure in each subpixel is the cell (display element). Since the arrangement pattern of the partition 29 is a stripe pattern, the portion of the discharge space 30 corresponding to each column is continuous in the column direction over all rows.

Figure 3:
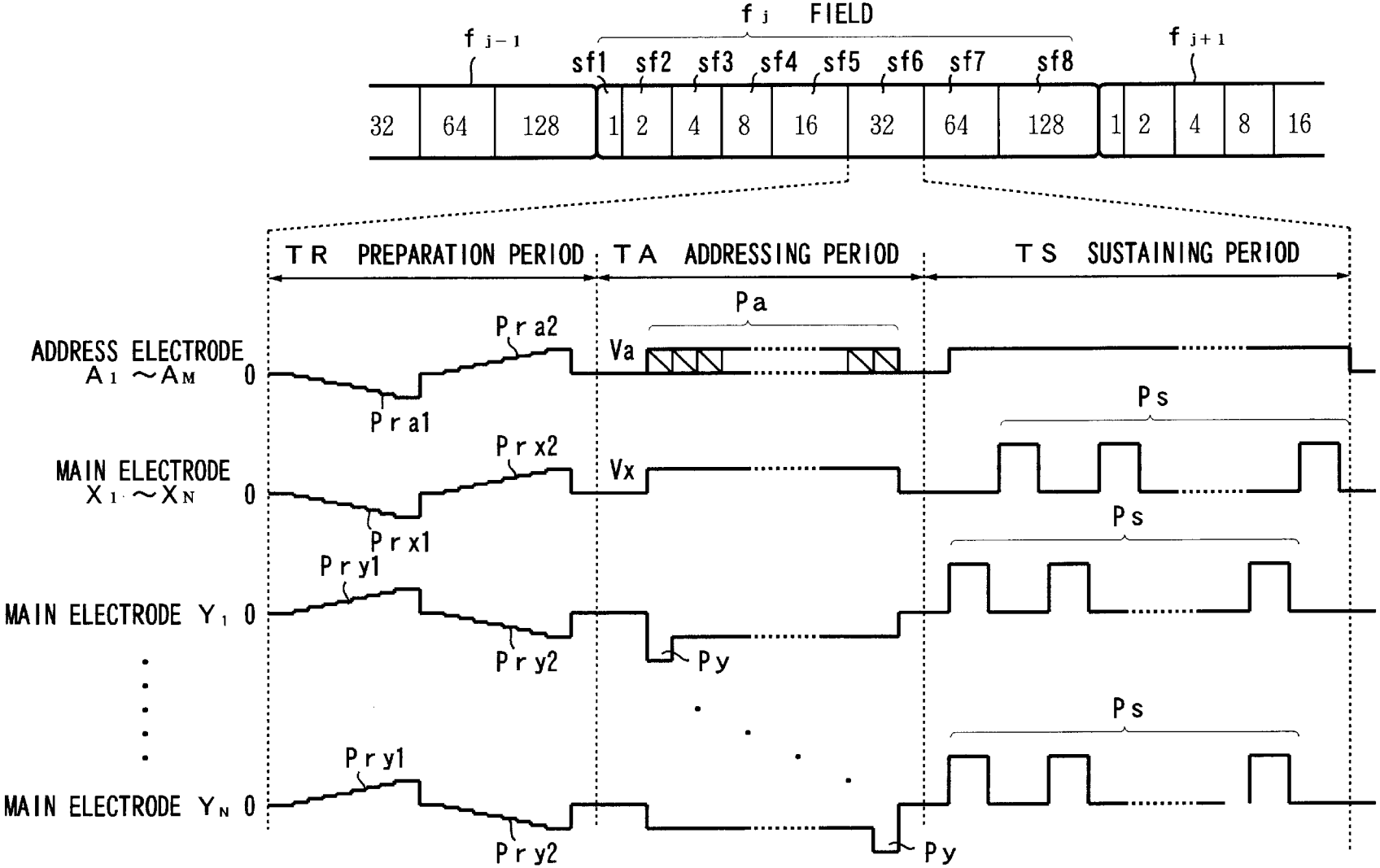
FIG. 3 shows an example of a drive sequence.

FIG. 3 shows an example of a drive sequence. In this figure, reference characters of the main electrodes X, Y are suffixed by the character (1, 2, . . . N) indicating the arrangement order of the corresponding row, while the reference characters of the address electrodes A are suffixed by the character (1-M) indicating the arrangement order of the corresponding column.

In the display of the television picture, sequential fields f (the suffix of the reference character indicates the display order) of the input image is divided into eight subframes sf1, sf2, sf3, sf4, sf5, sf6, sf7 and sf8, for example. Namely, the fields f constituting the frame are replaced by a set of eight subframes sf1–sf8. When reproducing a non-interlace image such as a computer output, each frame is divided into eight. The ratios of relative intensity in these subfields sf1–sf8 are set to approximately 1:2:4:8:16:32:64:128 by weighting and determining the number of the sustaining discharge times of each subfield sf1–sf8. The intensity can be set to 256 steps for each color by the combination of on state and off state of each subfield. The number of colors that can be reproduced is $256^3$.

The subfield period assigned to each subfield sf1–sf8 includes a preparation period TR for making the charge distribution of the screen uniform, an addressing period TA for forming a charge distribution corresponding to display contents and a sustaining period (that is also referred to as a display period) TS for sustaining the lightened state so as to secure the intensity corresponding to the gradation level. The length of the preparation period TR and the addressing period TA is constant despite of the weight of the intensity, but the length of the sustaining period TS is larger for the larger weight of the intensity. Namely, the lengths of eight subfield periods corresponding to a field f are different from each other.

The drive sequence that is repeated for each subfield will be explained generally as follows.

In the preparation period TR, a pulse Pra1 and a pulse Pra2 having a polarity opposite to the pulse Pra1 are applied sequentially to all address electrodes $A_1$–$A_M$, a pulse Prx1 and a pulse Prx2 having a polarity opposite to the pulse Prx1 are applied sequentially to all of the main electrodes $X_1$–$X_N$, and a pulse Pry1 and a pulse Pry2 having a polarity opposite to the pulse Pry1 are applied sequentially to all of the main electrodes $Y_1$–$Y_N$. The application of the pulse means biasing the electrode briefly to a potential different from the reference potential (the grand potential). The pulses Pra1, Pra2, Prx1, Prx2, Pry1 and Pry2 are step pulses having changing rate in which a micro discharge can be generated and are supplied by the drive circuit according to the present invention. In this example, the pulse Pra1 and Prx1 have the negative polarity and the pulse Pry1 has a positive polarity. The pulse Pra2, Prx2 and Pry2 are applied so that the wall voltage can be adjusted to a value corresponding to the difference between the discharge starting voltage and the pulse amplitude. The pulses Pra1, Prx1 and Pry1 are applied so that an appropriate wall voltage having the same polarity can be generated to all cells despite on or off of the previous subfield.

In the addressing period TA, the wall charge that is necessary for sustaining is formed only in the cell to be lightened. All main electrodes $X_1$–$X_N$ and all main electrodes $Y_1$–$Y_N$ are biased to a predetermined potential Vx, while the scanning pulse Py is applied to a main electrode Y that corresponds to the selected row for each row selection period (a scanning period of a row). At the same time of this row selection, an address pulse Pa is applied only to the address electrode A corresponding to the selected cell in which the address discharge is to be generated. Namely, the potential of the address electrode $A_1$–$A_M$ is controlled to zero or Va in accordance with the subfield data Dsf of M columns of the selected row. In the selected cell, a discharge is generated between the main electrode Y and the address electrode A, which causes the surface discharge between the main electrodes. This set of sequential discharges is the address discharge.

In the sustaining period TS, a sustaining pulse Ps having a predetermined polarity (the positive polarity in the illustrated example) is applied to all main electrodes $Y_1$–$Y_N$ first. After that, the main electrode $X_1$–$X_N$ and the main electrode $Y_1$–$Y_N$ are supplied with the sustaining pulse Ps alternately. The application of the sustaining pulse Ps causes the surface discharge in the cell having a predetermined remaining wall charge. Then, the polarity of the wall voltage between the electrodes changes at every generation of the surface discharge. In order to prevent an undesired discharge over the sustaining period TS, the address electrodes $A_1$–$A_M$ are biased in the same polarity as the sustaining pulse Ps.

The amplitude, the polarity and the timing of the drive waveform can be changed variously. For example, in the preparation period TR, one of the electrodes can be supplied with a step pulse.

Next, the structure of the drive circuit according to the present invention will be explained with reference to the example of the X common driver 55.

Figure 4:
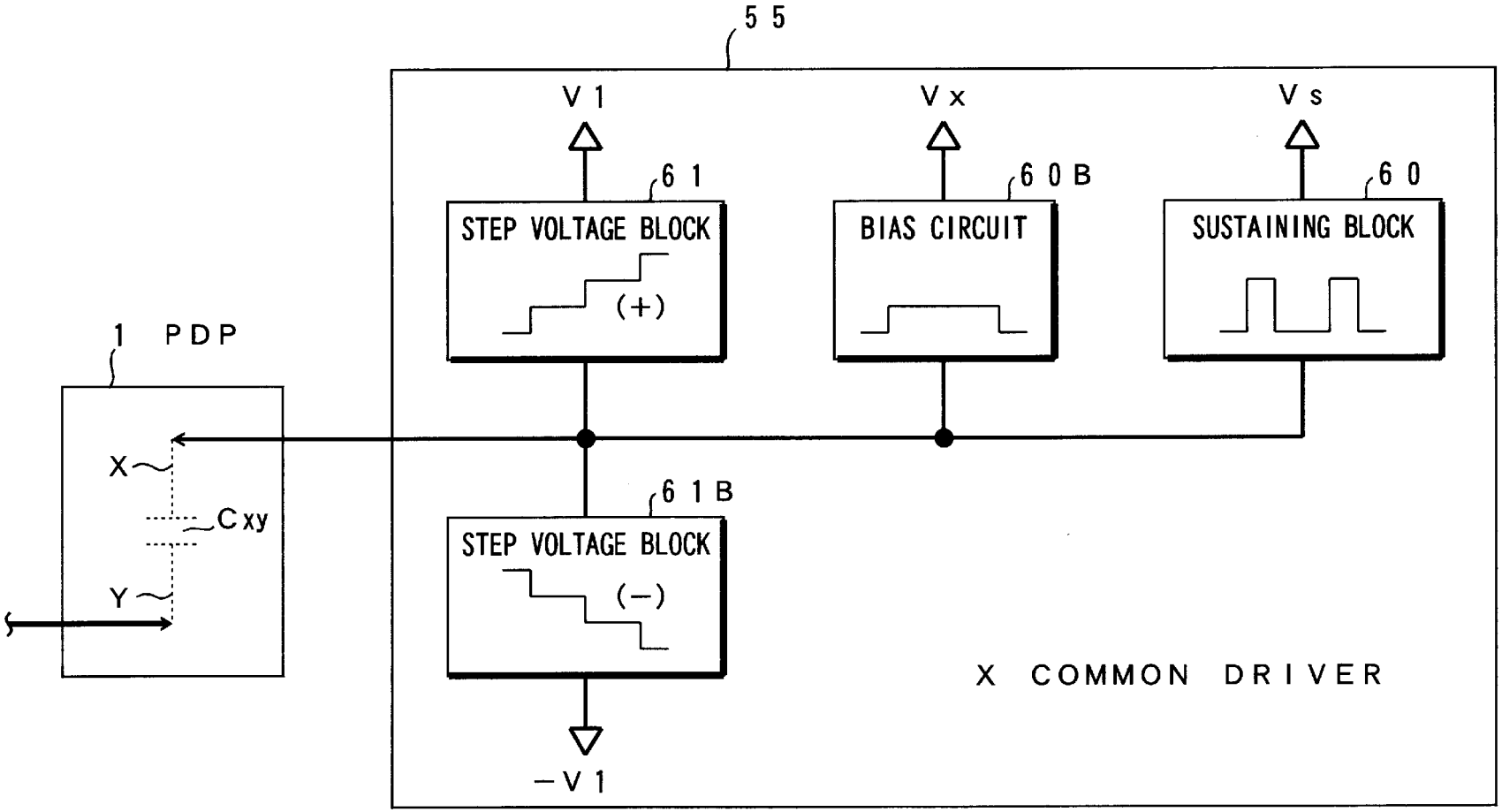
FIG. 4 shows a structure of the X common driver.

FIG. 4 shows a structure of the X common driver.

The X common driver 55 includes a step voltage block 61 that applies a positive step pulse, a step voltage block 61B that applies a negative step pulse, a bias circuit 60B that pulls up the main electrode X to the potential Vx and a sustaining block 60 that applies a sustaining pulse. The sustaining block 60 has a power recycling circuit that saves a power necessary for charging and discharging the capacitance between the main electrodes (not shown).

Figure 5:
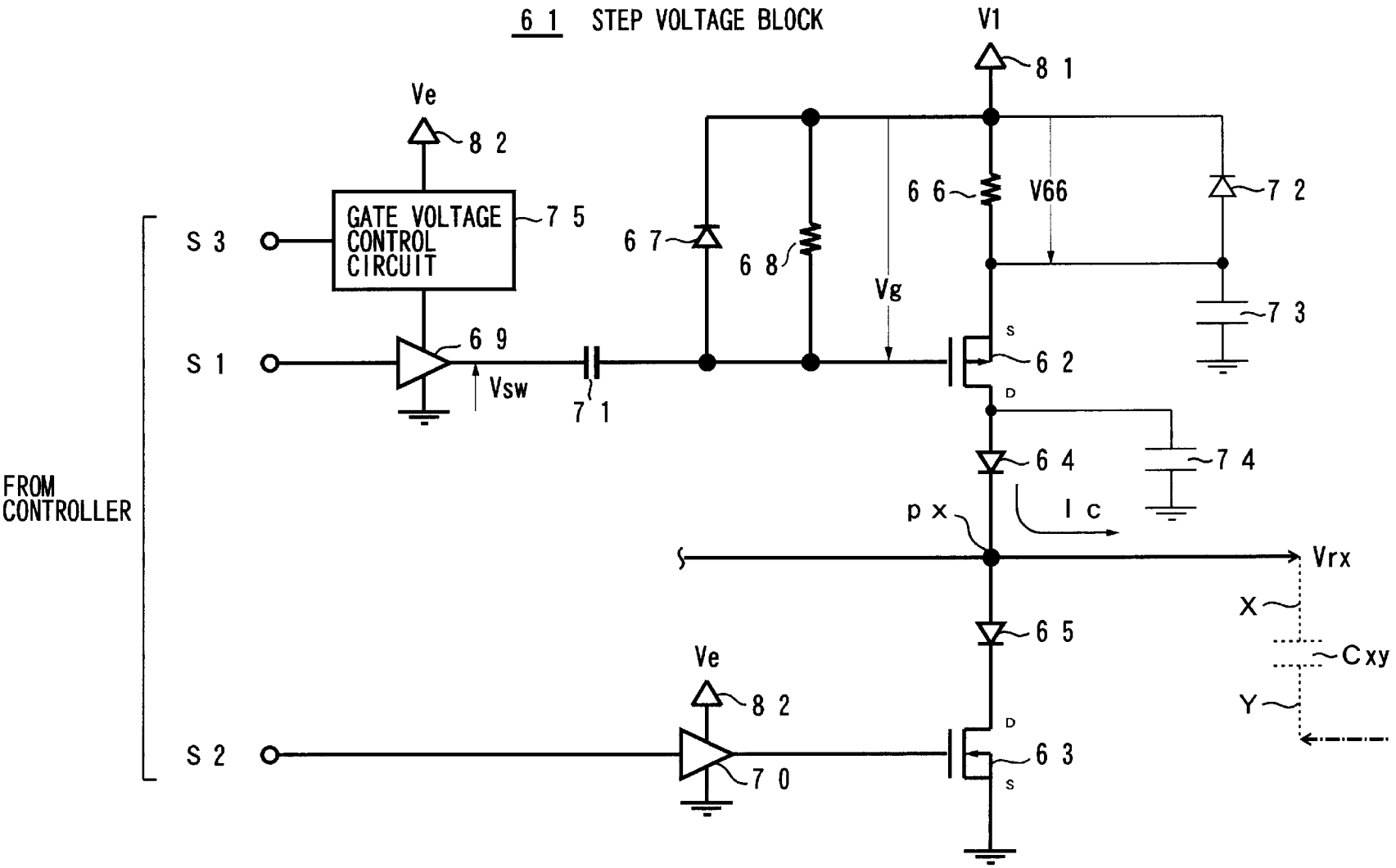
FIG. 5 is a circuit diagram of the step voltage block.

FIG. 5 is a circuit diagram of the step voltage block. Through a pulse with a positive polarity is applied in this circuit, the circuit configuration of the step voltage block 61B is the same as the step voltage block 61 except for the difference of the polarity.

The step voltage block 61 includes a p-channel FET 62 that opens and close the current path between the output terminal px connected to the main electrode X and a power source of the potential V1 (bias potential line) 81, a current restricting resistor 66 inserted between the power source 81 and the source of the FET 62, an n-channel FET 63 that opens and closes the current path between the output terminal px and the ground potential line, gate drives 69, 70 that control the FETs 62, 63, a coupling capacitor 71, a bias resistor 68 that connects the power source 81 to the gate of the FET 62, a diode 67 connected to the bias resistor 68 in parallel, and a gate voltage control circuit 75 that changes an output current. The gate drivers 69, 70 and gate voltage control circuit 75 are supplied with a control signal (waveform data) by the controller 51. Each of the FETs 62, 63 can be made of plural elements connected in parallel for securing a current capacity. Since the output terminal px is connected to the above-mentioned sustaining block 60, backflow preventing diodes 64, 65 are inserted between the output terminal px and the FETs 62 and 63, respectively. As additional elements, a diode 72 is connected in parallel with the current restricting resistor 66 and in the opposite direction to the same, a capacitor 73 is inserted between the source of the FET 62 and the ground potential line, and a capacitor 74 is inserted between the drain of the FET 62 and the ground potential line.

Figure 6:
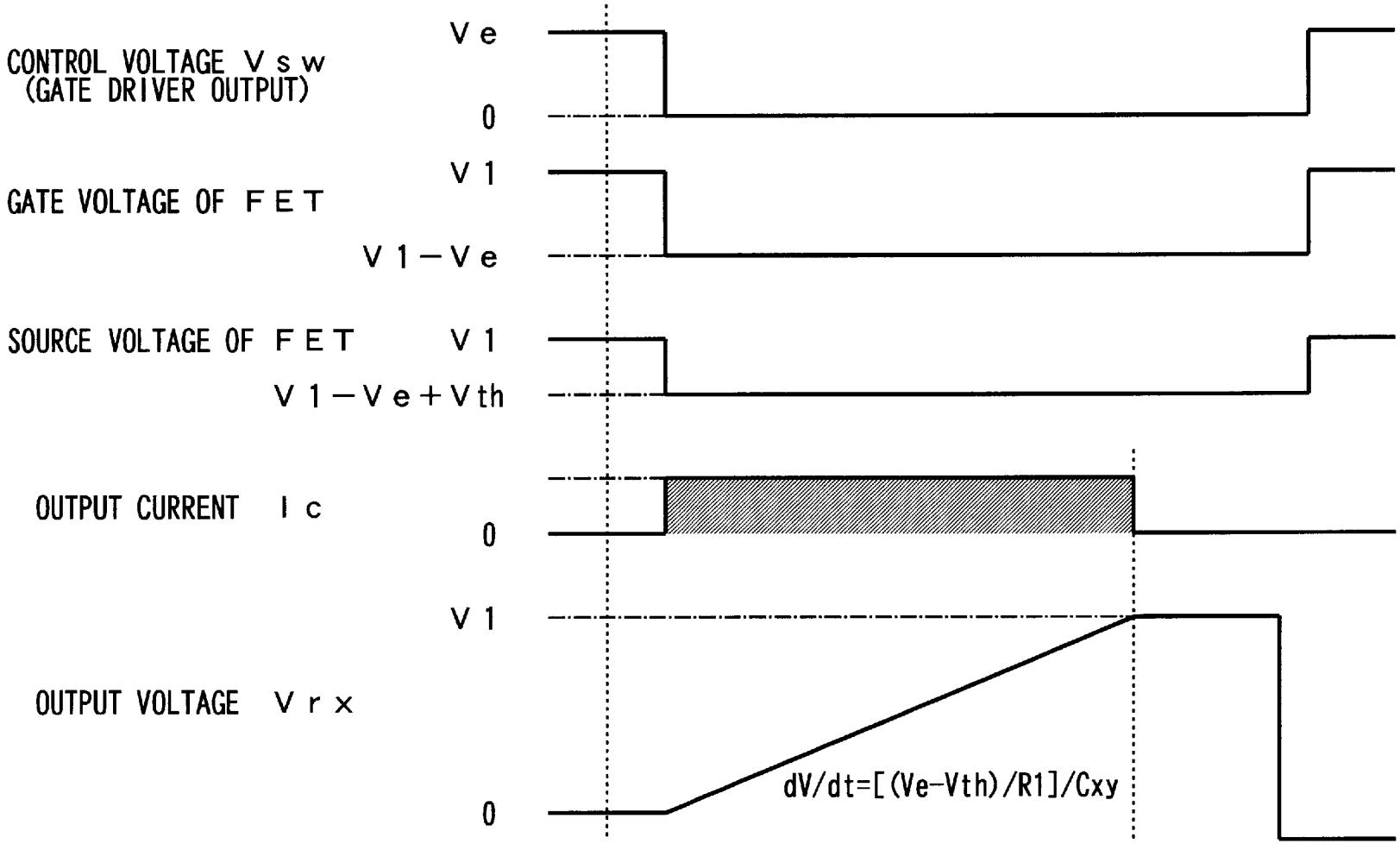
FIG. 6 shows waveforms of a first operational example of the step voltage block.

FIG. 6 shows waveforms of a first operational example of the step voltage block. The basic operation will be explained with reference to FIG. 6 and FIG. 5. Here, it is hypothesized that the gate voltage control circuit 75 is in through (i.e., conducting) state so that the gate driver 69 is supplied with a potential Ve by the power source 82 and the output terminal px is connected to a capacitive load Cxy via the main electrode X. The capacitive load Cxy is a sum of the individual capacitances of all cells to be driven.

The gate driver 69 outputs a pulse having an amplitude Ve obtained by shaping the control signal S1. The gate of the FET 62 is supplied with a control pulse having an amplitude. Ve based on the potential V1, so that the gate potential becomes Ve−V1. Since the amplitude Ve is set to a value larger than a threshold Vth between the gate and source of the FET 62 (Ve>Vth), the FET 62 is in a turned on state. When the FET 62 is turned on so that the current Ic flows from the power source 81 to the capacitive load Cxy, a voltage drop occurs in the current restricting resistor 66, and the source potential of the FET 62 becomes V1−Ve+Vth (that is the gate potential +Vth). When the FET 62 is turned on, the voltage Vg of the power source 81 and the gate is fixed. In this state, the voltage between the gate and the source changes corresponding to an increase or decrease of the voltage V66 between terminals of the current restricting resistor 66, so that the current Ic is maintained at a constant value (Ve−Vth)/R1. Therefore, the potential Vrx of the main electrode X increases at a constant gradient. The gradient can be controlled by a value R1 of the current restricting resistor 66 or the voltage Ve as defined in the equation, dV/dt=/Cxy. When the FET 62 is turned off and the FET 63 is turned on, the charge of the capacitive load Cxy is discharged via the diode 65 and the FET 63 to the ground potential line, and the output voltage goes back to zero volt (the ground potential). In this way, the FET 62 is turned on once so that the ramp voltage can be applied to a pair of the main electrodes. Since the discharge current flow is very little, even if a micro discharge occurs in the application period, the output voltage increases monotonously without dropping substantially.

The output (sustaining pulse) of the sustaining block 60 connected to the output terminal px along with the step voltage block 61 is a rectangular pulse having a rapid rising edge. If an impulse noise at the rising edge is added to the FET 62, a malfunction or a break down of the element can occur since the impulse voltage may be added between the source and the gate of the FET 62 whose power source impedance (R1) of source side is high. The diode 72 is provided for bypassing the impulse current that entered the source of the FET 62 to the power source 81. Thus, the malfunction or the break down can be prevented. The capacitor 72 has a function of absorbing the impulse current that entered the source of the FET 62 and reduces the same. In addition, the capacitor 74 has a role of adding charge to the capacitive load Cxy to prevent the drop of the output voltage when a micro discharge that is a relatively strong discharge occurs between the main electrodes.

Figure 7:
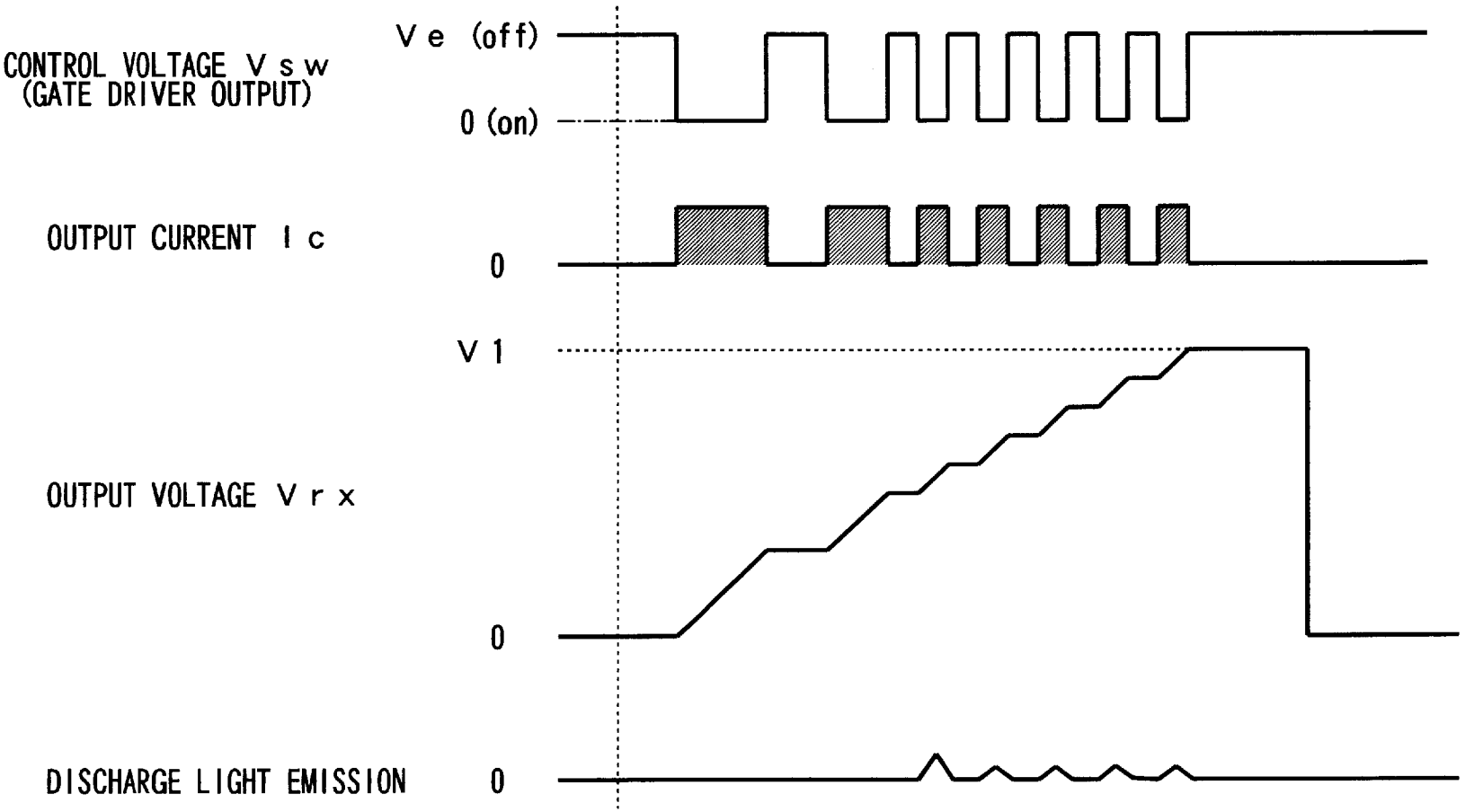
FIG. 7 shows waveforms of a second operational example of the step voltage block.

FIG. 7 shows waveforms of a second operational example of the step voltage block, which indicates the operation of applying the step voltage according to the present invention.

As explained above, the controller 51 has a waveform memory that memorizes pulse width modulation data for applying the step voltage. The pulse width modulation data are inputted to the gate driver 69 as a control signal SI. In this operational example, the FET 62 is not always turned on in the application period, but the output (control voltage) Vsw of the gate driver 69 is controlled binary so as to repeat ON and OFF of the FET 62, and the ON period and the OFF period are altered. In the ON period, the current Ic is maintained at a constant value as shown in FIG. 6, so the waveform of the output voltage Vrx becomes a ramp-like shape. In the OFF period, the output voltage Vrx is maintained by the charge sustaining function of the capacitive load Cxy at the value when the previous ON period finishes. Thus, the waveform of the output voltage becomes step-like shape. The height and the width of the step can be controlled by setting the ON/OFF timing. According to the waveform shown in FIG. 7, the micro discharge can be generated continuously.

Figure 8:
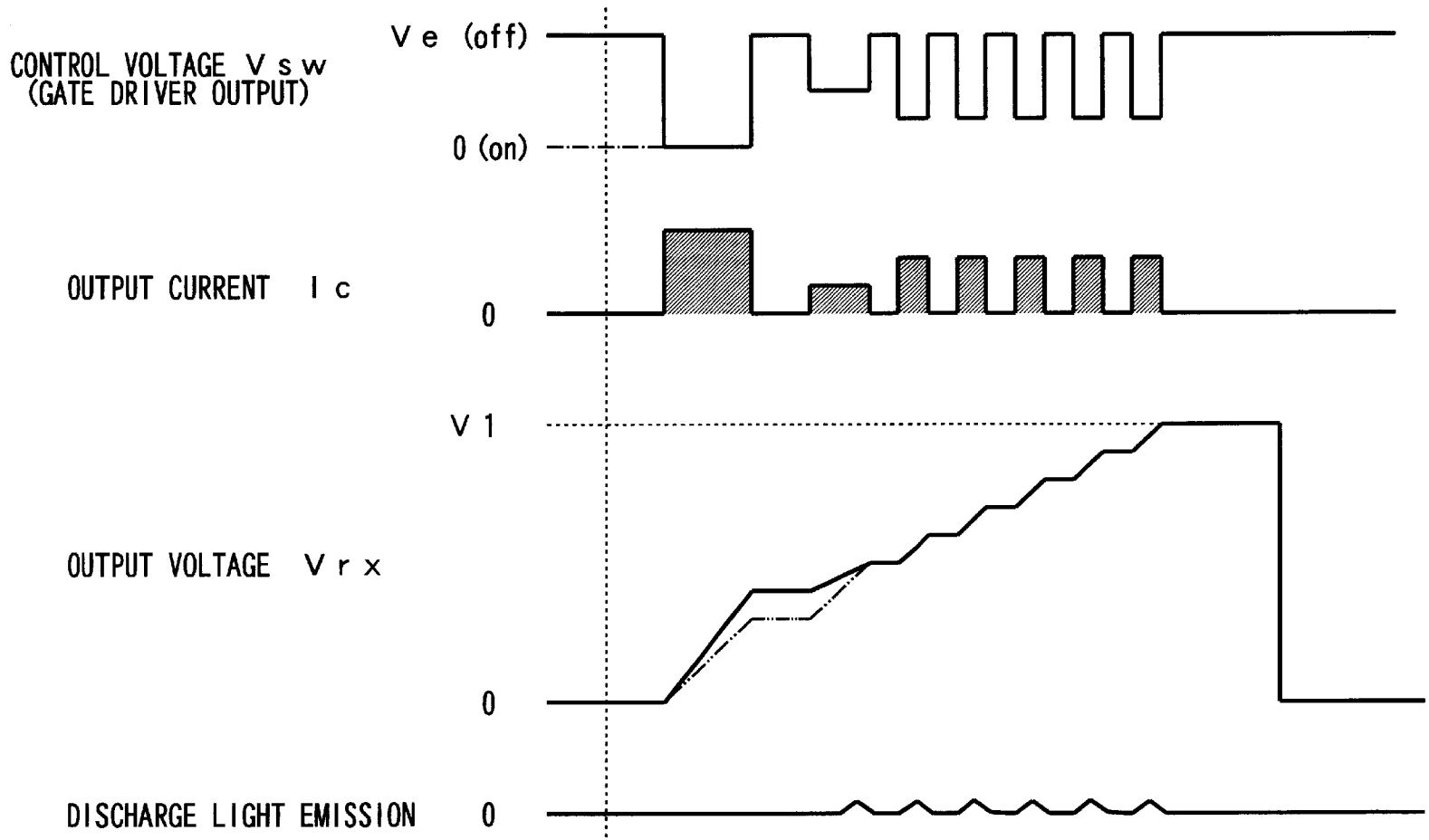
FIG. 8 shows waveforms of a third operational example of the step voltage block.

FIG. 8 shows waveforms of a third operational example of the step voltage block.

In this example, a gate voltage control circuit 75 is used for controlling the output (control voltage) Vsw of the gate driver 69 in multilevel. The output current Ic can be changed by setting the gate potential of the FET 62, so that the gradient of the ramp waveform portion of the output voltage Vrx can be optimized for every step of the step waveform. If the control voltage Vsw is increased, the output current Ic is increased and the gradient becomes large. On the contrary, if the control voltage Vsw is reduced, the gradient becomes small. The voltage waveform can be set in detail by combining the setting of the control voltage Vsw and the setting of the above-mentioned ON and OFF timings.

Figure 9:
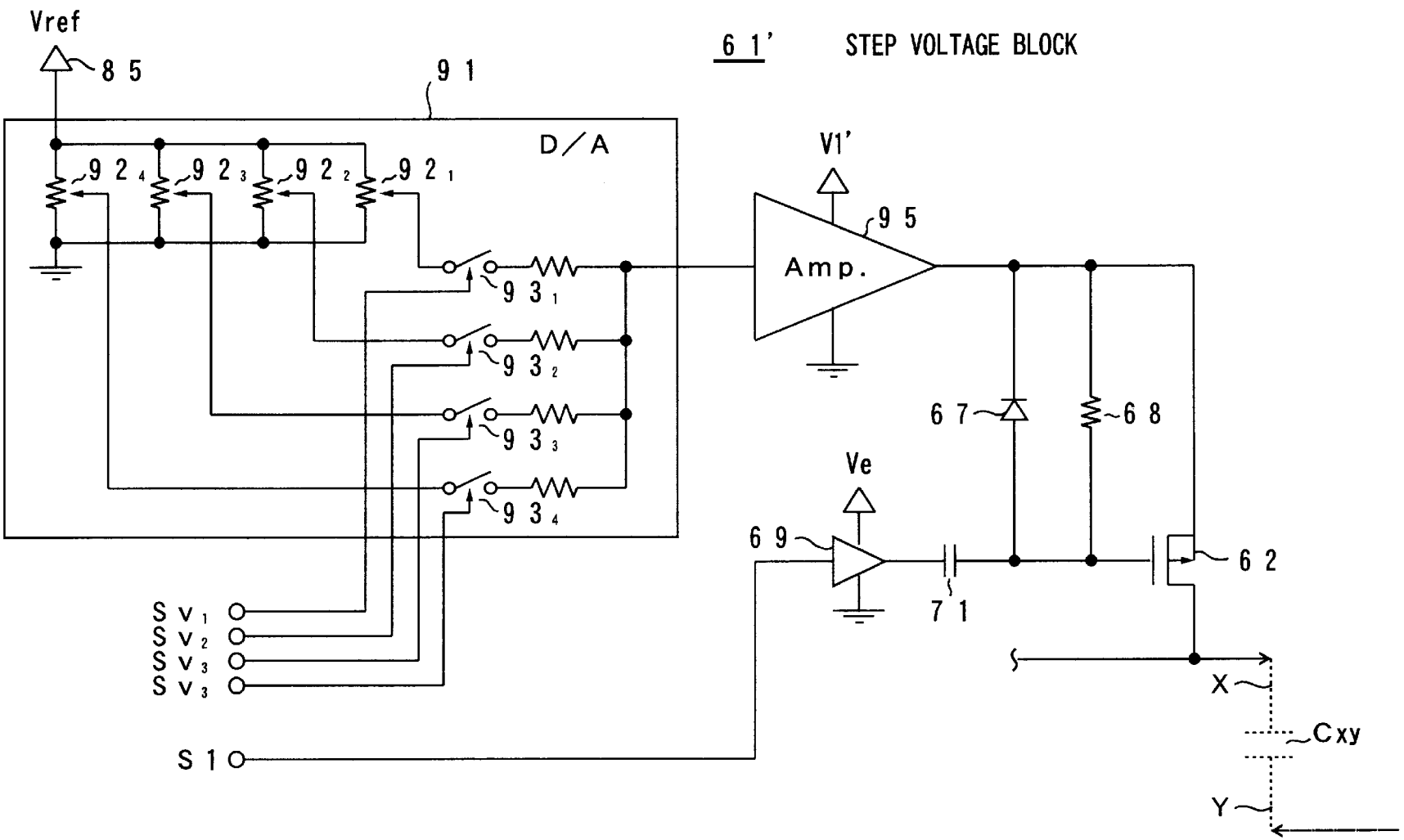
FIG. 9 is a circuit diagram of a variation of the step voltage block.
Figure 10:
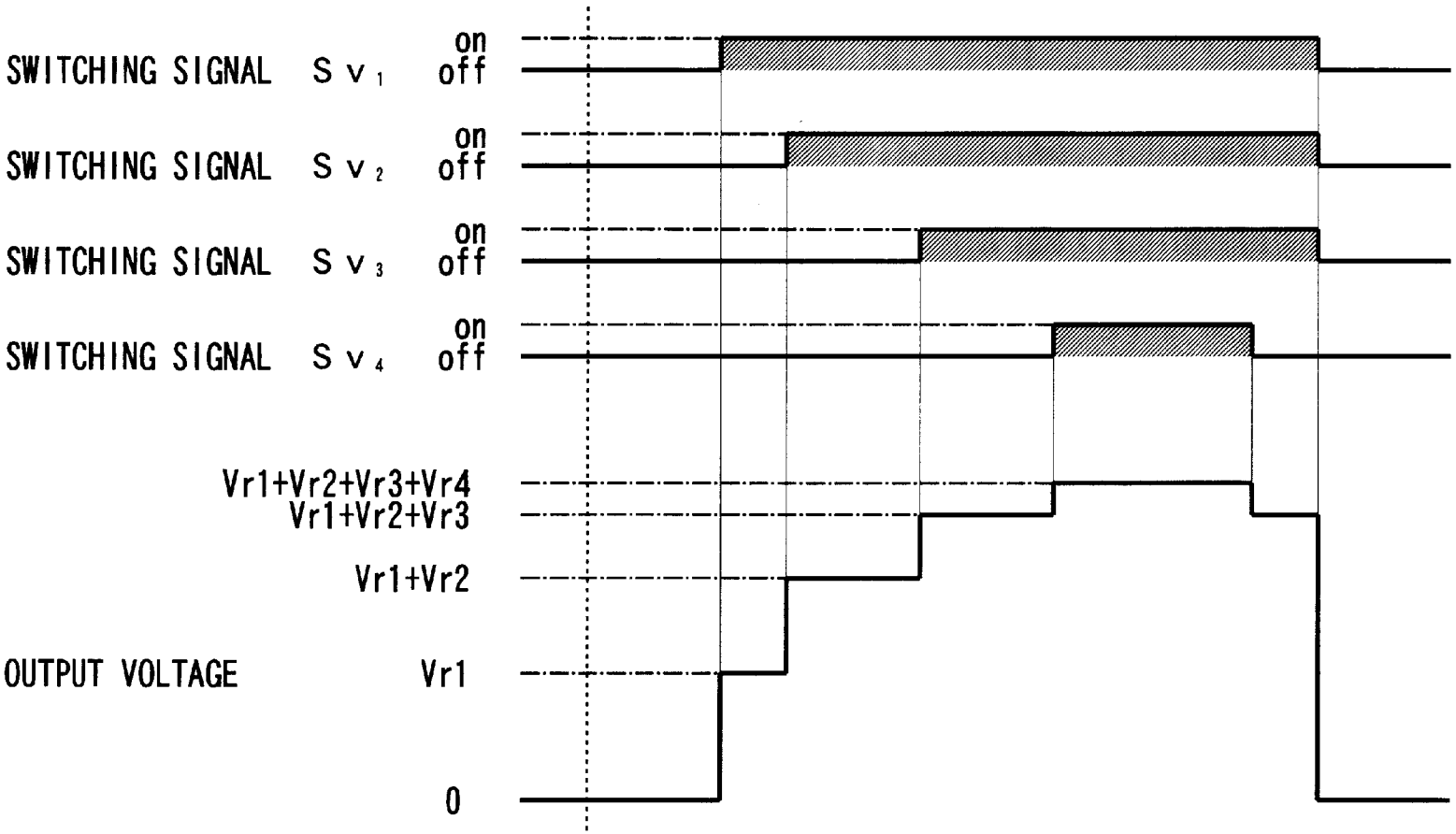
FIG. 10 shows operational waveforms of the variation of the step voltage block.

FIG. 9 is a circuit diagram of a variation of the step voltage block, and FIG. 10 shows operational waveforms of the variation of the step voltage block.

There is another method of applying a multilevel step voltage using a single power source. This method utilizes a digital-to-analog converter for converting the waveform data read out of the memory into a voltage signal. The digital-to-analog converter 91 of the step voltage block 61' shown in FIG. 9 is a circuit specialized in the step waveform, which includes plural voltage regulators (e.g., variable resistors) 92 and plural analog switches 93 for decreasing the reference voltage Vref of the power source 85. The step waveform can be obtained by combining an open state and a close state of the analog switch 93 by the signal Sv. However, in general, the output level of the digital-to-analog converter is approximately five volts. Therefore, in order to utilize the output of the digital-to-analog converter for a discharge control of the plasma display panel, a voltage amplifier circuit 95 is necessary for amplifying the output of the digital-to-analog converter up to approximately 200–300 volts. This voltage amplifier circuit 95 is made of many power devices, so it is inevitable that the step voltage block 61" becomes expensive.

As explained above, the setting of the step height in the application of the step voltage can be performed by a simple circuit configuration according to the present invention.

According to another aspect of the present invention, micro discharge having a uniform intensity can be generated periodically when applying the present invention to a gas discharge device.

According to still another aspect of the present invention, flexibility of setting the waveform is enhanced in driving the gas discharge display device, so as to optimize the drive.

According to still another aspect of the present invention, reliability of the drive can be improved.

According to still another aspect of the present invention, the voltage transition characteristics between the steps is set for each step, so that the waveform can have various shapes.

What is claimed is:

1. A method of applying a step voltage to a pair of electrodes presenting a capacitive load, the method comprising:

providing a current path, in which a constant current flows, from a power source to one of the pair of electrodes via a current restricting resistor and a switching path of a semiconductor switching device, in order; and controlling the flow of the constant current from the power source to the pair of electrodes intermittently by a switching control of the semiconductor switching device, so as to increase a charge quantity accumulated in a capacitance of the electrodes, step by step.

2. The method according to claim 1, wherein the voltage between a switching control terminal of the semiconductor switching device and the power source is maintained at a constant value in a period of closing the switching path, so as to make the step to step portion of the waveform of the charge voltage of a ramp-like shape.

3. A method of adjusting charge by gradually changing a wall charge formed on a dielectric that covers a pair of electrodes of a gas discharge display device, as a preparation process of addressing to control charge distribution of a screen of the gas discharge display device, the method comprising:

providing a current path, in which a constant current flows, from a power source to one of the pair of electrodes via a current restricting resistor and a switching path of a semiconductor switching device, in order; and controlling the flow of the constant current from the power source to the electrode intermittently by switching control of the semiconductor switching device, so as to increase a charge quantity accumulated in a capacitance of the electrodes, step by step.

4. A drive circuit for adjusting charge by gradually changing a wall charge formed on a dielectric that covers a pair of electrodes of a gas plasma display device, as a preparation process of addressing to control charge distribution of a screen of the gas discharge display device, the circuit comprising:

a first semiconductor switching device opening and closing a current path between an output terminal connected to one of the electrodes and a bias potential line;

a current restricting resistor inserted between the bias potential line and the first semiconductor switching device;

a second semiconductor switching device opening and closing a current path between the output terminal and a ground potential line;

a bias resistor connected to the bias potential line and a switching control terminal of the first semiconductor switching device; and a controller controlling the first and second semiconductor switching devices.

5. The drive circuit according to claim 4, further comprising a diode connected to the current restricting resistor in parallel therewith and in an opposite direction, and a capacitor inserted between a terminal of the bias potential line side of the first semiconductor switching device and the ground potential line.

6. The drive circuit according to claim 4, further comprising a variable voltage source switching a potential of a switching control terminal of the first semiconductor switching device.

7. The drive circuit according to claim 4, wherein the controller comprises a memory memorizing pulse width modulation data used by the controller for performing switching control.

8. A display device comprising a drive circuit for adjusting charge by gradually changing a wall charge formed on a dielectric that covers a pair of electrodes of a gas plasma display device as a preparation process of addressing to control charge distribution of a screen of the gas discharge display device, comprising:

a first semiconductor switching device opening and closing a current path between an output terminal connected to one of the electrodes and a bias potential line;

a current restricting resistor inserted between the bias potential line and the first semiconductor switching device;

a second semiconductor switching device opening and closing a current path between the output terminal and a ground potential line;

a bias resistor connected to the bias potential line and a switching control terminal of the first semiconductor switching device; and a controller controlling the first and the second semiconductor switching devices; and an AC type plasma display panel driven by the drive circuit.

9. A method of applying a step voltage to a pair of electrodes presenting a capacitive load, the method comprising:

providing a current path, in which a constant current flows, from a power source to one of the pair of electrodes via a current restricting resistor and a switching path of a field effect transistor, whose source is connected to one end of the current restricting resistor, in order; and controlling the flow of the constant current from the power source to the pair of electrodes intermittently by a switching control of the field effect transistor, so as to increase a charge quantity accumulated in a capacitance of the electrodes, step by step.

10. A method of adjusting charge by gradually changing a wall charge formed on a dielectric that covers a pair of electrodes of a gas discharge display device, as a preparation process of addressing to control charge distribution of a screen of the gas discharge display device, the method comprising:

providing a current path, in which a constant current flows, from a power source to one of the pair of electrodes via a current restricting resistor and a switching path of a field effect transistor, whose source is connected to one end of the current restricting resistor, in order; and controlling the flow of the constant current from the power source to the electrode intermittently by a switching control of the field effect transistor, so as to increase a charge quantity accumulated in a capacitance of the electrode, step by step.

* * * * *